US011240577B2

(12) United States Patent
Wilkey et al.

(10) Patent No.: US 11,240,577 B2
(45) **Date of Patent: *Feb. 1, 2022**

(54) SPEAKER COVER

(71) Applicant: Marine Speaker Covers Inc., Chesapeake, VA (US)

(72) Inventors: Brian Wilkey, Chesapeake, VA (US); Jared Egge, Chesapeake, VA (US)

(73) Assignee: Marine Speaker Covers Inc., Chesapeake, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/895,124

(22) Filed: Jun. 8, 2020

(65) Prior Publication Data

US 2020/0329291 A1 Oct. 15, 2020

Related U.S. Application Data

(63) Continuation-in-part of application No. 16/268,111, filed on Feb. 5, 2019, now Pat. No. 10,715,893.

(60) Provisional application No. 62/646,441, filed on Mar. 22, 2018.

(51) Int. Cl.
*H04R 1/02* (2006.01)

(52) U.S. Cl.
CPC ..... *H04R 1/026* (2013.01); *H04R 2201/021* (2013.01)

(58) Field of Classification Search
CPC ..... H04R 1/02; H04R 1/023; H04R 2201/02
See application file for complete search history.

(56) References Cited

U.S. PATENT DOCUMENTS 10,715,893 B2 * 7/2020 Wilkey ..... H04R 1/023

* cited by examiner

*Primary Examiner* — Walter F Briney, III
(74) *Attorney, Agent, or Firm* — Shaddock Law Group, PC

(57) ABSTRACT

A speaker cover having an exterior top portion; at least one exterior side wall extending from the exterior top portion; at least one pull tab extending from a portion of the speaker cover; an interior top wall formed substantially opposite at least a portion of the exterior top portion; an interior side wall formed substantially opposite at least a portion of the exterior side wall, wherein an at least partial interior cavity is defined by the interior top wall and the interior side wall; one or more side wall projections extending from at least a portion of the interior side wall; and optionally one or more top wall projections extend from at least a portion of the interior top wall.

20 Claims, 19 Drawing Sheets

SPEAKER COVER

CROSS-REFERENCE TO RELATED APPLICATIONS

This patent application is a continuation-in-part of U.S. patent application Ser. No. 16/268,111, filed Feb. 5, 2019, which claims the benefit of U.S. Patent Application Ser. No. 62/646,441, filed Mar. 22, 2018, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of protective covers. More specifically, the present disclosure relates to a speaker cover adaptable to be used with an audio speaker.

2. Description of Related Art

Speakers exist in many outdoor or other environments, such as on boats or on golf carts. These types of speakers are consistently exposed to the hazards of the atmosphere. They may be exposed to water damage from the ocean or the rain. Strong winds may cause damage from dirt, dust, or other small debris that could easily impair both the outer mechanics and sensitive inner workings of the speaker. Constant contact from the elements can cause outdoor speakers to wear out at a faster rate than indoor speakers, forcing owners to replace them earlier than a similarly built indoor speaker. This can create a substantial inconvenience to the owner and cause them to lose both time and money replacing the speaker.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

The speaker cover of the present disclosure provides a protective cover designed to safeguard speakers exposed to potential environmental damage.

In various exemplary, non-limiting embodiments, the speaker cover of the present disclosure includes a flange or a plurality of flanges along an outer rim or at least a portion of an outer rim thereof. The protective cover optionally comprises a plurality of fasteners operably connected to the flange of the speaker cover. The protective cover is optionally removably secured to a speaker through the plurality of fasteners or fastening points to create a seal around the speaker.

In various exemplary, non-limiting embodiments, the speaker cover of the present disclosure comprises an exterior top portion extending from a proximate center to an edge portion; at least one exterior side wall extending from the edge portion to an exterior terminal edge; at least one pull tab extending from a portion of the speaker cover; an interior top wall formed substantially opposite at least a portion of the exterior top portion, wherein the interior top wall extends from a proximate center to an interior edge portion; and an interior side wall formed substantially opposite at least a portion of the exterior side wall, wherein the interior side wall extends from the interior edge portion to the interior terminal edge, wherein an at least partial interior cavity is defined by the interior top wall and the interior side wall, wherein one or more top wall projections extend from at least a portion of the interior top wall into the interior cavity, and wherein one or more side wall projections extend from at least a portion of the interior side wall, at spaced apart locations, into the interior cavity.

In various exemplary, non-limiting embodiments, the speaker cover may be contoured or shaped to accommodate a specific type or model of speaker grill within the cavity.

In various exemplary, non-limiting embodiments, the exterior top portion is substantially dome shaped.

In various exemplary, non-limiting embodiments, the exterior top portion comprises a substantially planar surface.

In various exemplary, non-limiting embodiments, the edge portion is configured to a substantially circularly shaped or is configured to a geometric shape.

In various exemplary, non-limiting embodiments, indicia is formed as part of, applied to, embedded in, or attached or coupled to a portion of the exterior top portion.

In various exemplary, non-limiting embodiments, the pull tab extends from the exterior top portion or the edge portion.

In various exemplary, non-limiting embodiments, the pull tab extends from the exterior side wall.

In various exemplary, non-limiting embodiments, the pull tab includes a textured surface portion that can be tactilely distinguished from remaining portions of the pull tab or the speaker cover.

In various exemplary, non-limiting embodiments, the side wall projections extend from the interior edge portion to the interior terminal edge.

In various exemplary, non-limiting embodiments, an air gap is formed by the interior side wall, between each of the side wall projections.

In various exemplary, non-limiting embodiments, an air gap is formed by the interior top wall, between each of the top wall projections.

In various exemplary, non-limiting embodiments, the top wall projections comprise a plurality of elongate or linear projections that extend radially from an area surrounding the proximate center to the interior edge portion.

In various exemplary, non-limiting embodiments, the top wall projections comprise a plurality of sinusoidal or wave shaped projections, a plurality of spaced apart projections, or a plurality of concentric, substantially circular projections.

In various exemplary, non-limiting embodiments, the speaker cover is formed of an at least partially resilient material.

In various exemplary, non-limiting embodiments, the speaker cover of the present disclosure comprises an exterior top portion extending to an edge portion; at least one exterior side wall extending from the edge portion; at least one pull tab extending from a portion of the speaker cover; an interior top wall formed substantially opposite at least a portion of the exterior top portion, wherein the interior top wall extends from a proximate center to an interior edge portion; and an interior side wall formed substantially opposite at least a portion of the exterior side wall, wherein the interior side wall extends from the interior edge portion, wherein an at least partial interior cavity is defined by the interior top wall and the interior side wall, wherein one or more elongate or linear top wall projections extend radially from an area proximate the proximate center into the interior cavity, and wherein one or more side wall projections extend from at least a portion of the interior side wall, at spaced apart locations, into the interior cavity.

In various exemplary, non-limiting embodiments, the speaker cover of the present disclosure comprises an exterior top portion; at least one exterior side wall extending from the exterior top portion; at least one pull tab extending from a portion of the speaker cover; an interior top wall formed substantially opposite at least a portion of the exterior top portion; an interior side wall formed substantially opposite at least a portion of the exterior side wall, wherein an at least partial interior cavity is defined by the interior top wall and the interior side wall; and one or more side wall projections extending from at least a portion of the interior side wall.

In various exemplary, non-limiting embodiments, one or more top wall projections extend from at least a portion of the interior top wall.

In various exemplary, non-limiting embodiments, the speaker cover of the present disclosure comprises an exterior top portion extending from a proximate center to an edge portion; at least one exterior side wall extending from the edge portion to an exterior terminal edge; an interior top wall formed substantially opposite at least a portion of the exterior top portion, wherein the interior top wall extends from a proximate center to an interior edge portion; an interior side wall formed substantially opposite at least a portion of the exterior side wall, wherein the interior side wall extends from the interior edge portion to an interior terminal edge, wherein an at least partial interior cavity is defined by the interior top wall and the interior side wall, wherein one or more top wall projections are formed integral to the interior top wall, wherein the one or more top wall projections extend from at least a portion of the interior top wall into the interior cavity to rest atop a portion of a speaker, wherein one or more side wall projections are formed integral to the interior side wall, and wherein the one or more side wall projections extend from at least a portion of the interior side wall, at spaced apart locations, into the interior cavity; and a cover element having at least one pull tab extending from a portion of the cover element, wherein the cover element is attached or coupled to at least a portion of the exterior top portion.

In various exemplary, non-limiting embodiments, the cover element is substantially rigid.

In various exemplary, non-limiting embodiments, the speaker cover of the present disclosure comprises a cover element having an exterior top portion extending to an edge portion; an interior top wall formed substantially opposite at least a portion of the exterior top portion, wherein the interior top wall extends from a proximate center to an interior edge portion; a substantially flexible skirt element extending from at least a portion of the interior edge portion, the skirt element having at least one exterior side wall extending from a skirt element edge portion; an interior side wall formed substantially opposite at least a portion of the exterior side wall, wherein the interior side wall extends from the interior edge portion, wherein an at least partial interior cavity is defined by the interior top wall and the interior side wall, wherein one or more integrally formed elongate or linear top wall projections extend radially from an area proximate the proximate center into the interior cavity to rest atop a portion of a speaker, and wherein one or more integrally formed side wall projections extend from at least a portion of the interior side wall, at spaced apart locations, into the interior cavity.

In various exemplary, non-limiting embodiments, the speaker cover of the present disclosure comprises an exterior top portion; at least one exterior side wall extending from the exterior top portion; an interior top wall formed substantially opposite at least a portion of the exterior top portion; an interior side wall formed substantially opposite at least a portion of the exterior side wall, wherein an at least partial interior cavity is defined by the interior top wall and the interior side wall; one or more integrally formed top wall projections extending from at least a portion of the interior top wall configured to rest atop a portion of a speaker; one or more integrally formed side wall projections extending from at least a portion of the interior side wall; and a cover element attached or coupled to at least a portion of the exterior top portion.

In various exemplary, non-limiting embodiments, the speaker cover of the present disclosure comprises an exterior top portion extending to an edge portion; at least one exterior side wall extending from the edge portion; an interior top wall formed substantially opposite at least a portion of the exterior top portion, wherein the interior top wall extends from a proximate center to an interior edge portion; an interior side wall formed substantially opposite at least a portion of the exterior side wall, wherein the interior side wall extends from the interior edge portion, wherein an at least partial interior cavity is defined by the interior top wall and the interior side wall, and wherein one or more integrally formed top wall projections extend from the interior top wall into the interior cavity to rest atop a portion of a speaker; and a substantially flexible skirt element having an interior side wall, wherein one or more integrally formed side wall projections extend from at least a portion of the interior side wall, at spaced apart locations, and wherein the skirt element is positioned within the interior side wall.

Accordingly, the speaker cover of the present disclosure separately and optionally provides a protective cover, or shield, for a speaker.

The speaker cover of the present disclosure separately and optionally provides a releasable or removable protective cover, or shield, for a speaker.

The speaker cover of the present disclosure separately and optionally provides a speaker cover, which is frictionally securable to a speaker, via a plurality of fastening points.

The speaker cover of the present disclosure separately and optionally provides a speaker cover that includes gaps between each fastening point, which allow for the circulation of air under portions of the speaker cover.

The speaker cover of the present disclosure separately and optionally provides a speaker cover that includes one or more projections, extending from interior surfaces of the speaker cover, to provide gaps between each projection, which allow for the circulation of air under portions of the speaker cover.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
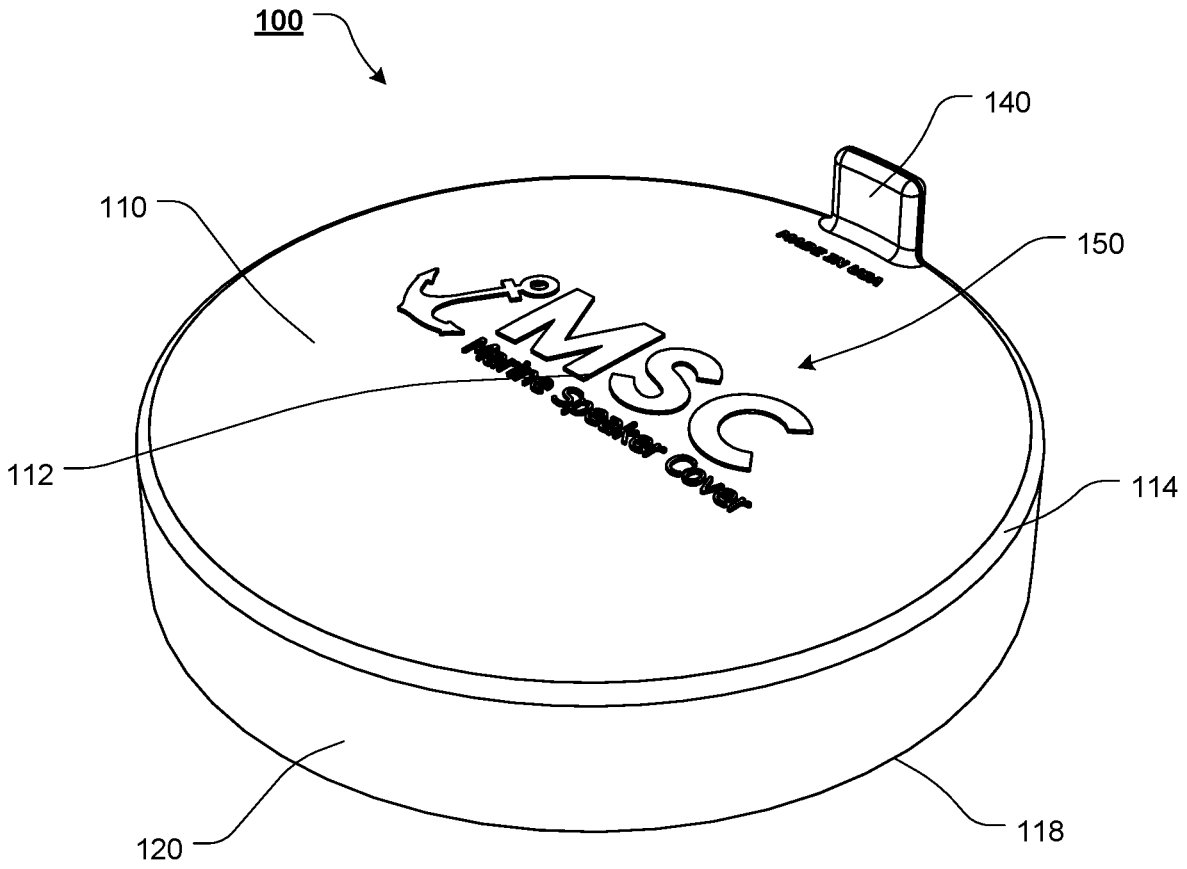
FIG. 1 illustrates an upper, perspective view of an exemplary embodiment of a speaker cover, according to the present disclosure.
Figure 2:
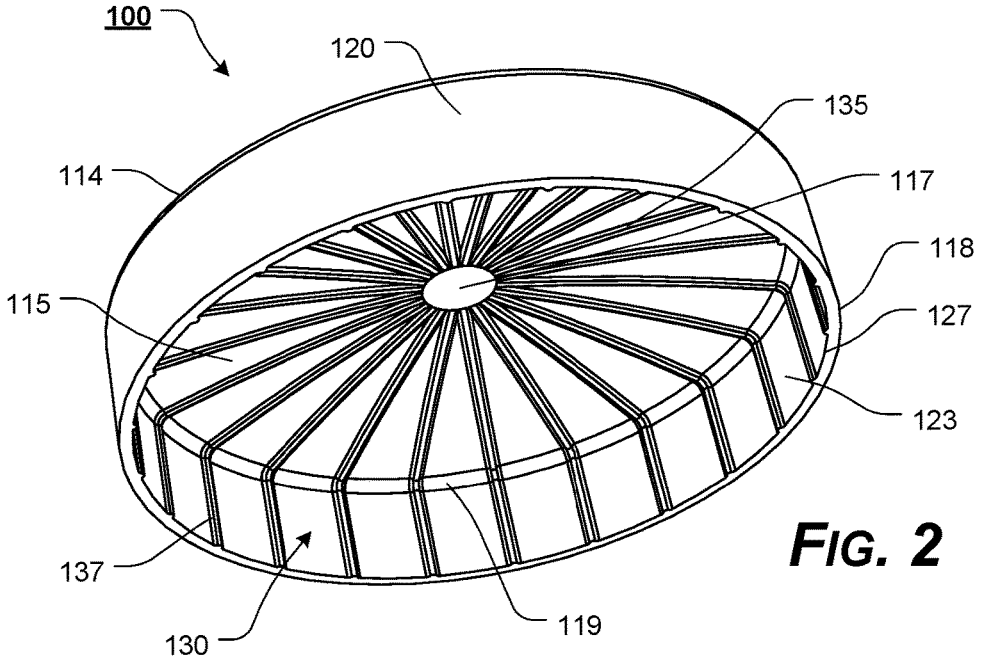
FIG. 2 illustrates a lower, perspective view of an exemplary embodiment of a speaker cover, according to the present disclosure.
Figure 3:
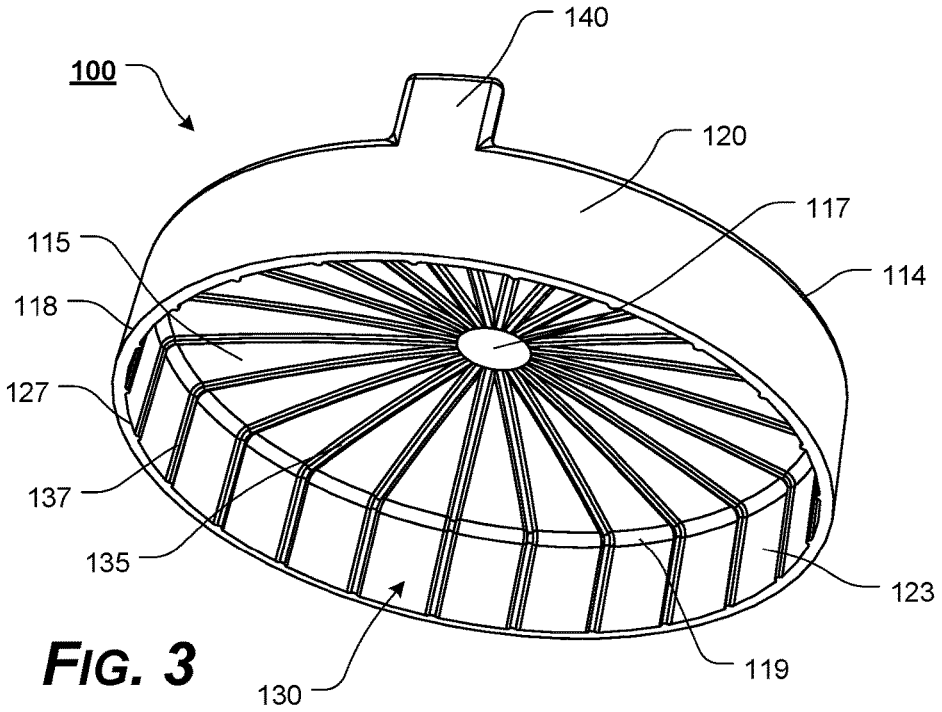
FIG. 3 illustrates a lower, perspective view of an exemplary embodiment of a speaker cover, according to the present disclosure.
Figure 4:
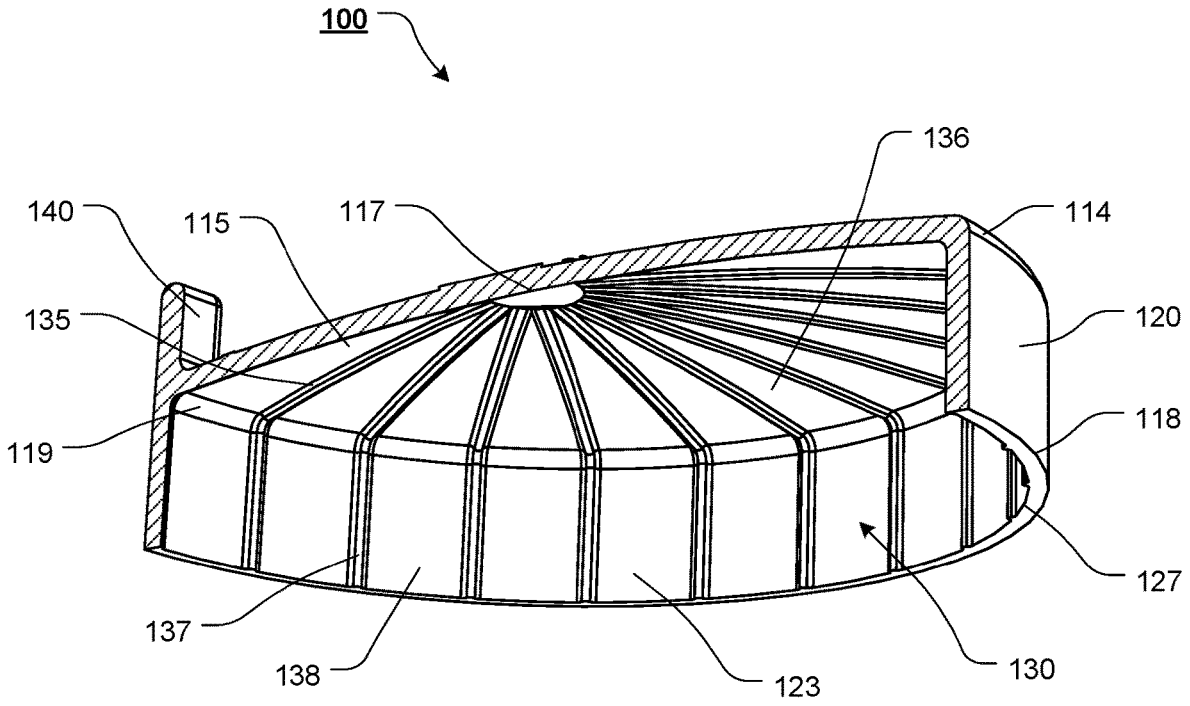
FIG. 4 illustrates a lower, perspective, cross-sectional view, taken along line 4-4 of FIG. 5, of an exemplary embodiment of a speaker cover, according to the present disclosure.
Figure 5:
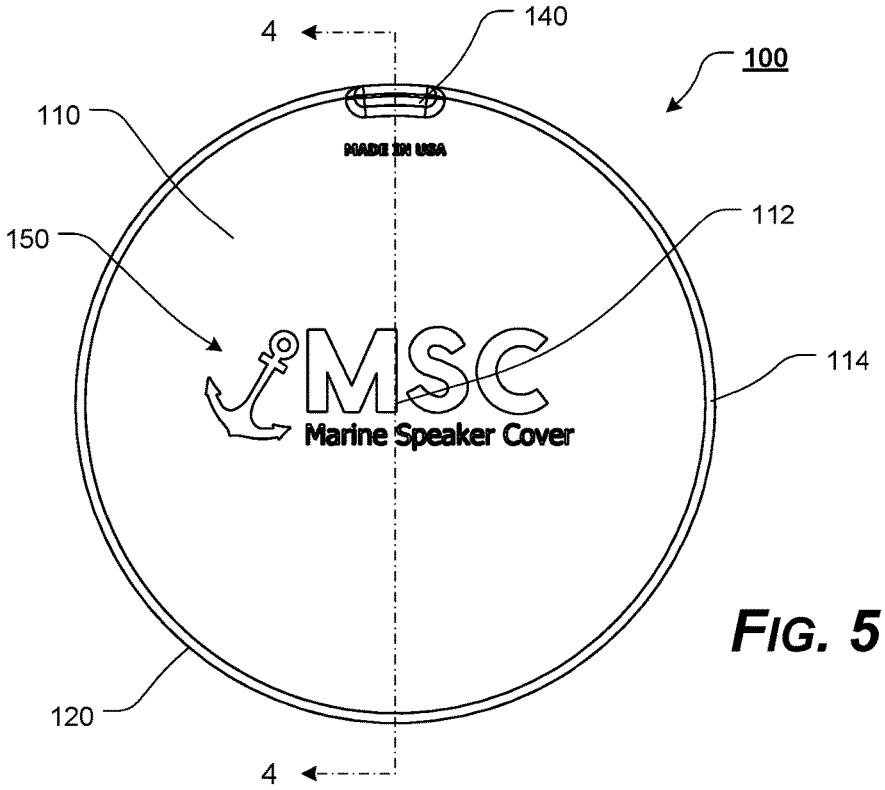
FIG. 5 illustrates a top view of an exemplary embodiment of a speaker cover, according to the present disclosure.
Figure 6:
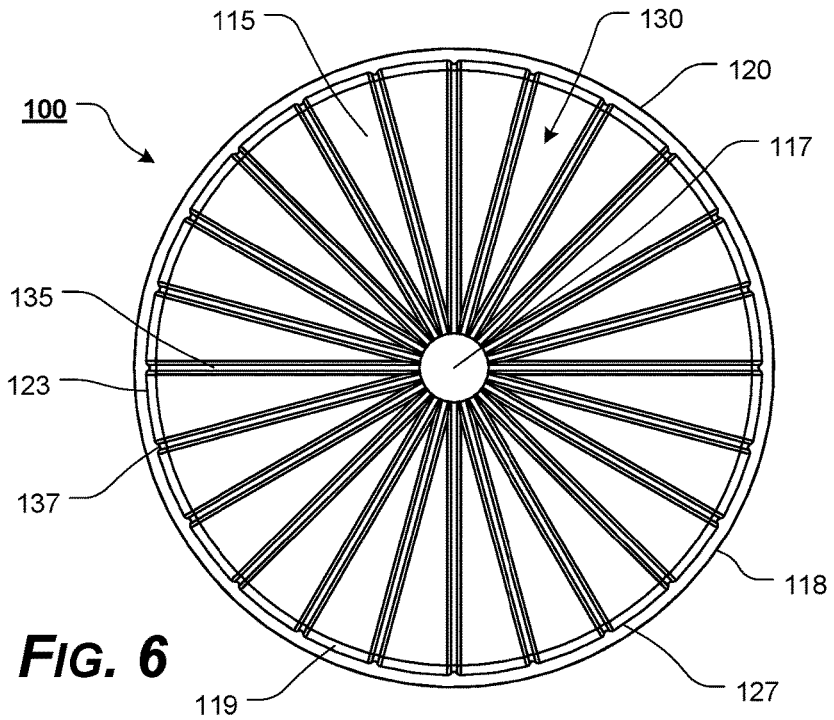
FIG. 6 illustrates a bottom view of an exemplary embodiment of a speaker cover, according to the present disclosure.
Figure 7:
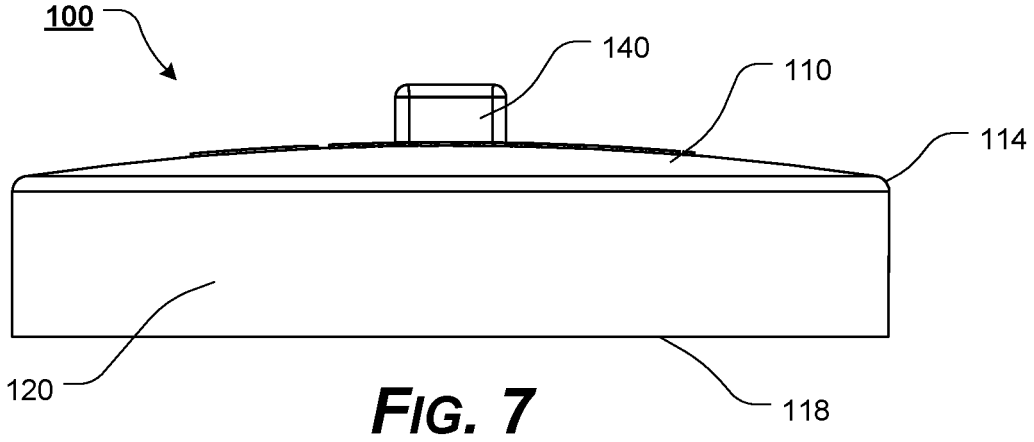
FIG. 7 illustrates a side view of an exemplary embodiment of a speaker cover, according to the present disclosure.
Figure 8:
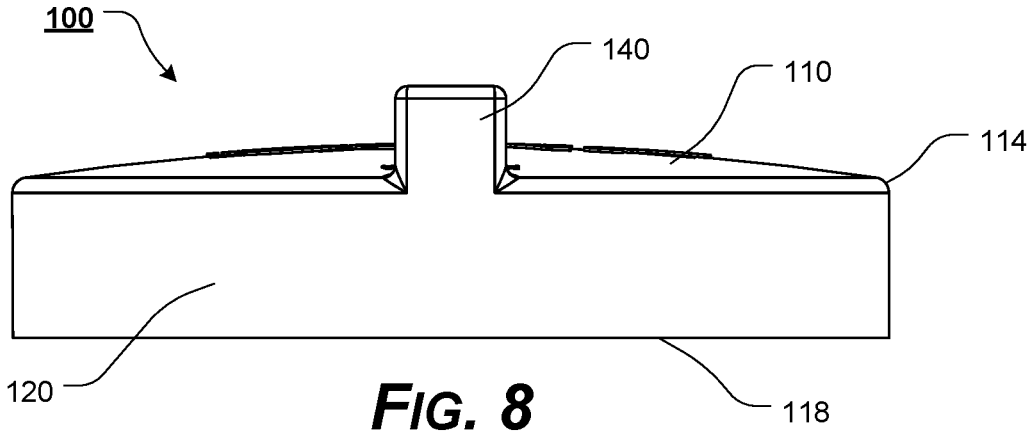
FIG. 8 illustrates a side view of an exemplary embodiment of a speaker cover, according to the present disclosure.
Figure 9:
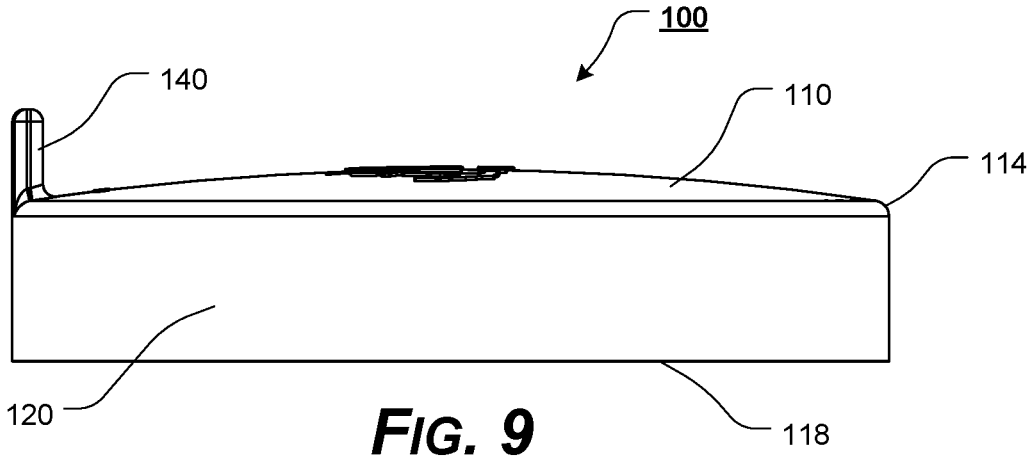
FIG. 9 illustrates a side view of an exemplary embodiment of a speaker cover, according to the present disclosure.

For simplicity and clarification, the design factors and operating principles of the speaker cover according to the present disclosure are explained with reference to various exemplary embodiments of a speaker cover according to the present disclosure. The basic explanation of the design factors and operating principles of the speaker cover is applicable for the understanding, design, and operation of the speaker cover of the present disclosure. It should be appreciated that the speaker cover can be adapted to many applications where a speaker cover can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "speaker", "protective", and "speaker cover" are used for a basic explanation and understanding of the operation of the systems, methods, and apparatuses of the present disclosure. Therefore, the terms "speaker", "protective", and "speaker cover" are not to be construed as limiting the systems, methods, and apparatuses of the present disclosure.

Furthermore, it should be appreciated that, for simplicity and clarification, the embodiments of the present disclosure will be described with reference to a circular speaker grill being secured within the protective speaker cover of the present disclosure. However, it should be appreciated that the operating principles of the disclosed speaker cover may also be employed to construct speaker covers for any sized or shaped speaker grill (i.e., eventually circular, substantially ovular, substantially square, substantially rectangular, etc.), so long as the speaker grill (or a portion of the structure surrounding or adjacent the speaker grill) includes an appropriate edge, ledge, or other surface extension or feature that may be engaged or retained by side wall projections of the speaker cover. Furthermore, it is also within the scope of the speaker cover of the present disclosure that the present speaker cover may be employed as a protective cover for other items or accessories that may be exposed to the elements.

Figure 11:
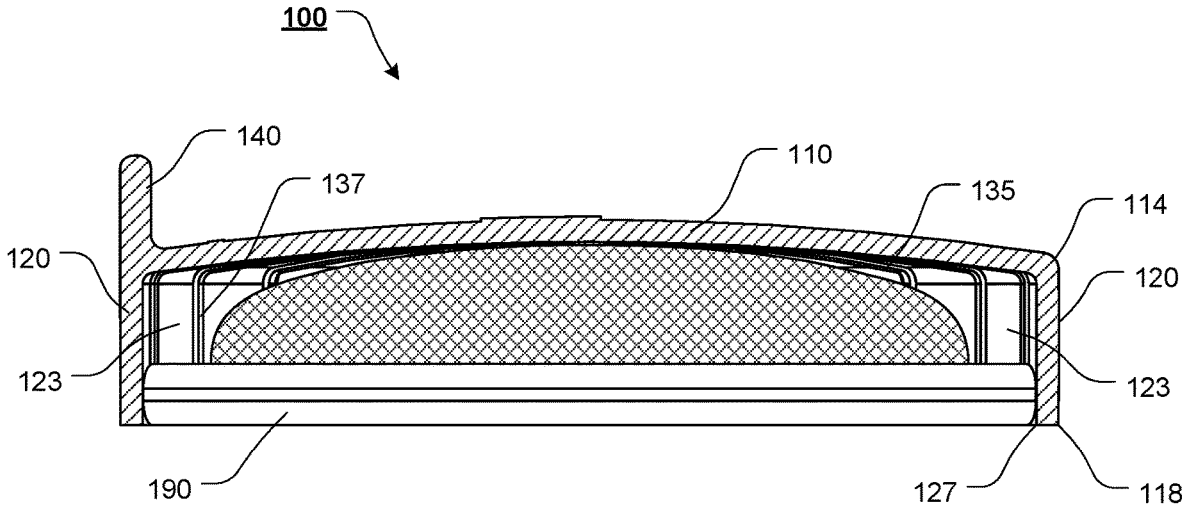
FIG. 11 illustrates a partial cross-sectional view, wherein exemplary speaker cover is positioned about an exemplary speaker grill and the speaker grill is at least partially seated within the speaker cover, according to the present disclosure.
Figure 12:
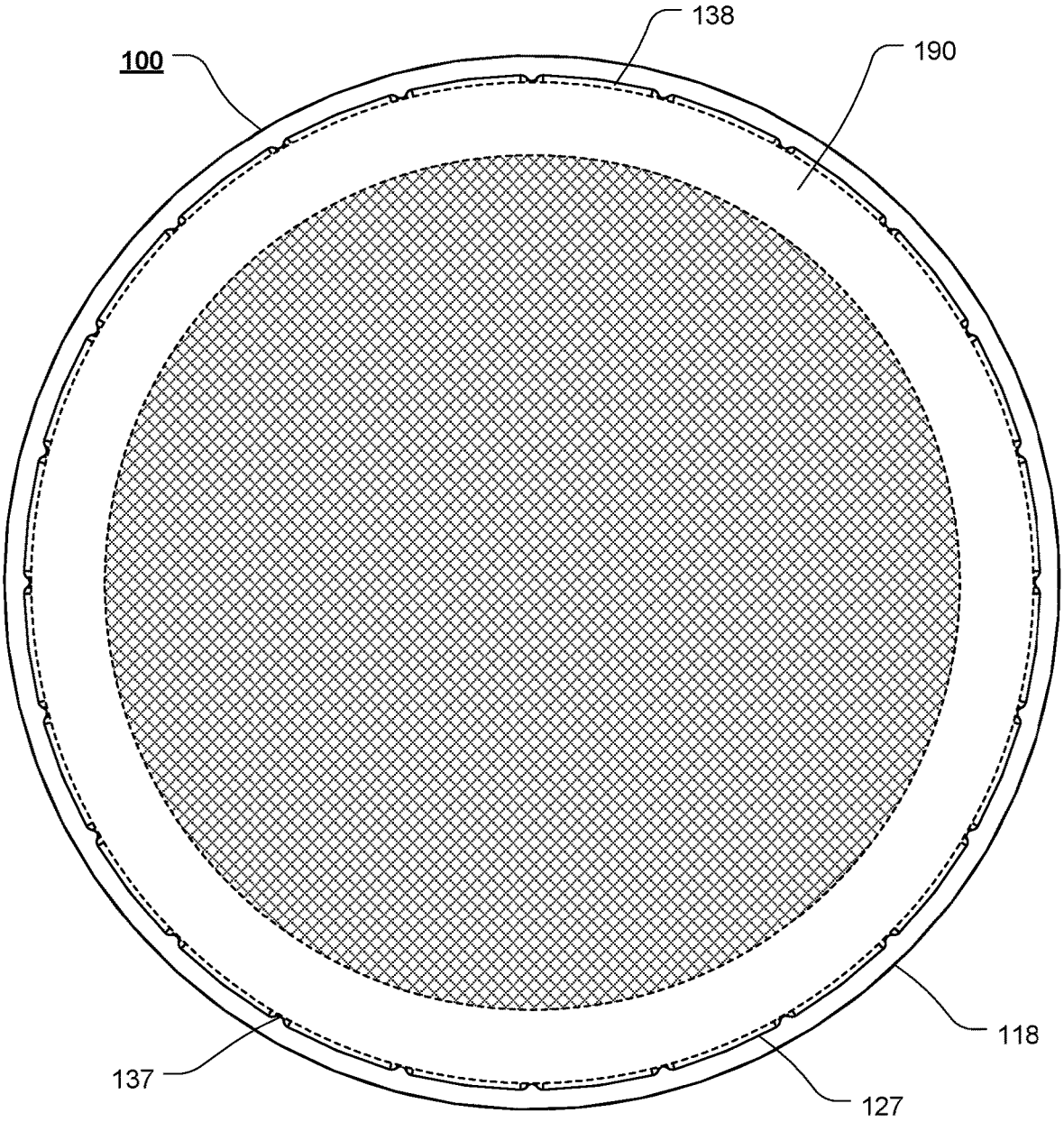
FIG. 12 illustrates a bottom view, wherein exemplary speaker cover is positioned about an exemplary speaker grill and the speaker grill is at least partially seated within the speaker cover, according to the present disclosure.
Figure 13:
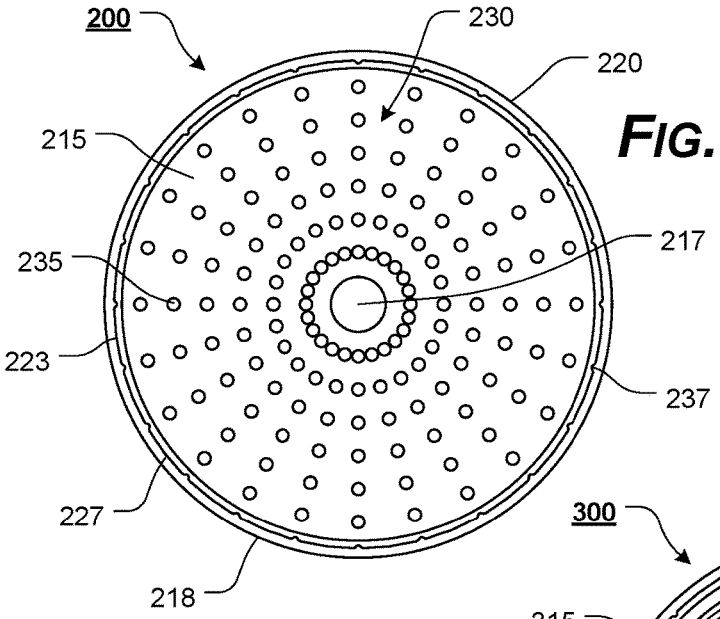
FIG. 13 illustrates a bottom view of an exemplary embodiment of a speaker cover, according to the present disclosure.
Figure 14:
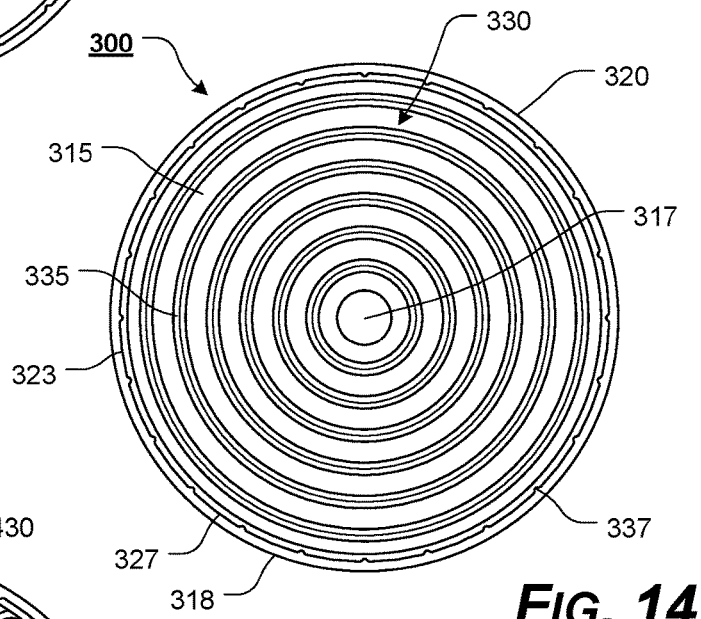
FIG. 14 illustrates a bottom view of an exemplary embodiment of a speaker cover, according to the present disclosure.
Figure 15:
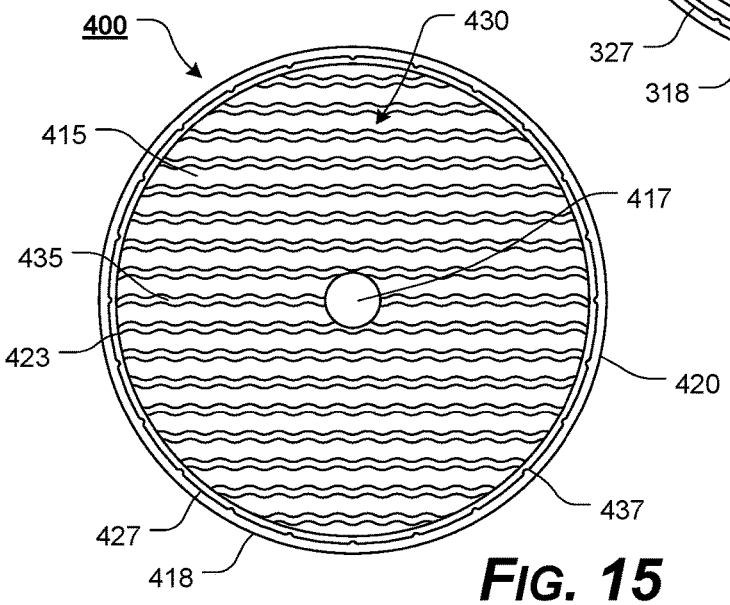
FIG. 15 illustrates a bottom view of an exemplary embodiment of a speaker cover, according to the present disclosure.

Turning now to the appended drawing figures, FIGS. 1-12 illustrate certain elements and/or aspects of a speaker cover 100 according to present disclosure, while FIGS. 13-15 illustrate certain other exemplary elements and/or aspects of a speaker cover 200, 300, or 400, respectively. It should be appreciated that the speaker cover 100 is adapted to retain an exemplary speaker grill 190. The speaker grill 190 generally includes a grill portion 192 and a frame portion 194. However, it should be appreciated that the grill portion 192 and the frame portion 194 are optional and not required. The frame portion 194, if included generally includes an outer surface 195, which defines the outer perimeter of the frame portion 194, while the grill portion 192 extends from the frame portion 194 and generally defines an upper extent of the speaker grill 190.

In various exemplary, nonlimiting embodiments, the speaker cover 100 comprises a substantially circularly shaped speaker cover 100 having an exterior top portion 110 and at least one exterior side wall 120. The exterior top portion 110 generally extends from a proximate center 112 to an edge portion 114. In various exemplary embodiments, the exterior top portion 110 of the speaker cover 100 extends outward from the proximate center 112 in a domed shape. The exterior side wall 120 extends from the edge portion 114 to an exterior terminal edge 118.

It should be noted that the speaker cover 100 may be contoured or shaped to better accommodate a specific type or model of speaker grill 190 to be retained within the speaker cover 100.

In certain illustrative, nonlimiting embodiments, the exterior top portion 110 of the speaker cover 100 comprises a dome that extends to a substantially planar or flat surface portion. In other embodiments, the substantially planar or flat surface portion is less extended to allow for greater space in the area surrounding the speaker grill 190, should the speaker cover 100 be used in a small or tight-fitting area. As illustrated, the speaker cover 100 comprises a generally circular shape. However, in certain other embodiments, the speaker cover 100 is configured to a square, rectangular, or other geometric shape, depending on size and shape of the speaker grill with which the speaker cover 100 is to be utilized.

In various exemplary, nonlimiting embodiments, indicia 150 may optionally be formed as part of, applied to, embedded in, or attached or coupled to a portion of the exterior top portion 110. If included, the indicia 150 may represent a trademark or other word, phrase, or element, thereby providing additional originality to the speaker cover 100.

At least one pull tab 140 extends from a portion of the speaker cover 100. In various exemplary embodiments, the pull tab 140 is positioned so as to extend from the exterior top portion 110 and provide sufficient area to be grasped by a user's fingers so that a removing force can be applied to the speaker cover 100 and the speaker cover 100 can be removed from a speaker grill 190.

Figure 17:
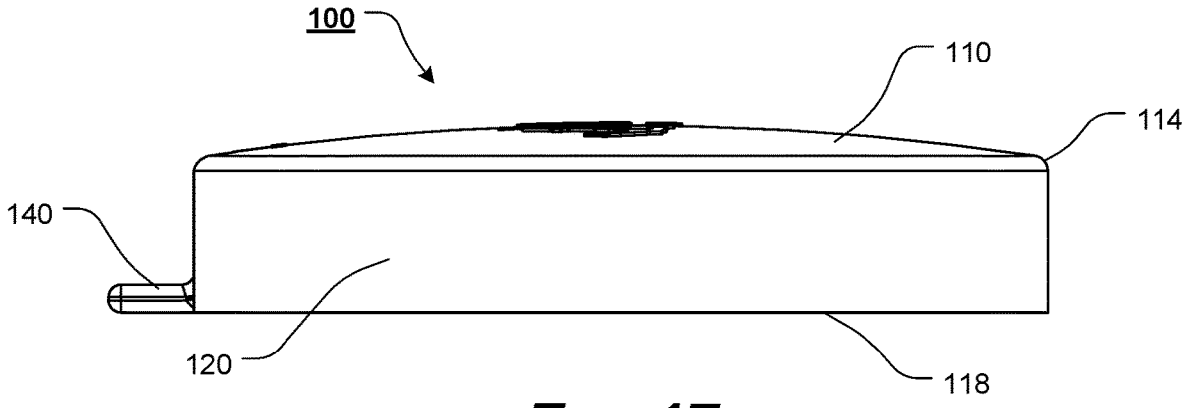
FIG. 17 illustrates a side view of an exemplary embodiment of a speaker cover, according to the present disclosure

In certain exemplary embodiments, one or more pull tabs 140 are disposed proximate the exterior side wall 120 or the edge portion 114 of the speaker cover 100. Alternatively, one or more pull tabs 140 may optionally extend from the exterior side wall 120 of the speaker cover 100, as illustrated, for example, in FIG. 17.

The pull tab 140 may optionally provide a gripping or textured surface portion having a surface preparation that allows for better purchase of the pull tab 140 or allows the textured surface portion to be tactilely distinguished from the remaining portions of the pull tab 140 or the speaker cover 100. The gripping or textured surface portion may optionally comprise a plurality of raised protrusions or projections along one or more exterior surfaces of the pull tab 140 along regularly or randomly spaced patterns or intervals, to allow for greater ease in removing the speaker cover 100.

While the pull tab 140 can be positioned at any desired location relative to the speaker cover 100, if that the pull tab 140 is positioned proximate the exterior side wall 120, a removal force can be more easily applied to the speaker cover 100 to urge a discrete portion of the speaker cover 100 from a speaker grill 190, resulting in easier removal of the speaker cover 100.

If the pull tab 140 is positioned closer to the proximate center 112 of the speaker cover 100 a removal force is applied or equally to the entire exterior side wall 120 of the speaker cover 100.

The overall size, shape, and/or texture of the pull tab 140 is a design choice, based upon the desired appearance and/or desired tactile properties of the pull tab 140.

The speaker cover 100 defines an at least partial interior cavity 130 for receiving at least a portion of a speaker grill 190. The at least partial interior cavity 130 is defined by the interior top wall 115 and the interior side wall 123. The interior top wall 115 generally extends from a proximate center 117 to an interior edge portion 119.

In various exemplary embodiments, the interior top wall 115 of the speaker cover 100 is generally formed substantially opposite at least a portion of the exterior top portion 110 and extends outward from the proximate center 117 in a domed shape.

The interior side wall 123 is generally formed substantially opposite at least a portion of the exterior side wall 120 and extends from the interior edge portion 119 to the interior terminal edge 127. In certain illustrative, nonlimiting embodiments, the interior top wall 115 of the speaker cover 100 comprises a dome or partial dome. The height or distance that each side wall projection 137 extends above the interior side wall 123 is a design choice.

One or more side wall projections 137 extend from the interior side wall 123, at spaced apart locations, into the interior cavity 130. As illustrated, the side wall projections 137 extend from the interior edge portion 119 to the exterior terminal edge 118. In certain alternative embodiments, the side wall projections 137 only extend along a portion of the interior side wall 123.

By including the one or more side wall projections 137, air gaps 138 are formed by the interior side wall 123, between each of the side wall projections 137. In this manner, when the speaker cover 100 is removably or releasably position about a speaker grill 190, the side wall projections 137 contact at least a portion of the outer surface 195 of the frame portion 194 of the inserted speaker grill 190. The air gaps 138 allow air to flow between portions of the inserted speaker grill 190 and the interior side wall 123.

One or more top wall projections 135 extend from the interior top wall 115 into the interior cavity 130. As illustrated, the top wall projections 135 comprise a plurality of elongate or linear projections that extend radially from an area surrounding the proximate center 117 to the interior edge portion 119. The height or distance that each side wall projection 137 extends above the interior side wall 123 is a design choice.

By including the one or more top wall projections 135, air gaps 136 are formed by the interior top wall 115, between each of the top wall projections 135. In this manner, when the speaker cover 100 is removably or releasably position about a speaker grill 190, the top wall projections 135 contact at least a portion of the outer surface of the grill portion 192 of the speaker grill 190. The air gaps 136 allow air to flow between portions of the inserted speaker grill 190 and the interior top wall 115.

By allowing air to flow or circulate between portions of the interior side wall 123 and/or the interior top wall 115, pressure can be equalized between the interior cavity 130 and the outside environment. Additionally, allowing air to flow or circulate between portions of the interior side wall 123 and/or the interior top wall 115 keeps moisture or condensation from building up between the interior cavity and the speaker grill 190. If air gaps 138 and/or 136 are not provided, an airtight or watertight seal would be formed between the interior side wall 123 and the speaker grill 190. Such an airtight or watertight seal would promote the buildup of moisture condensation within the speaker grill 190.

In various exemplary, nonlimiting embodiments, the speaker cover 100 is formed of an at least partially resilient material, such as silicon or vulcanized rubber. In certain other exemplary embodiments, the speaker cover 100 is formed of a plastic or other material such as polyethylene, polypropylene, polyvinyl chloride, polystyrene, polybenzimidazole, acrylic, nylon, Teflon, or any other thermoplastic, thermoset, or thermosetting polymer.

In this manner, the speaker cover 100 may provide a degree of cushioning protection to a speaker grill 190, provide a degree of resilient flexibility for repeatably attaching and removing the speaker cover 100 may speaker grill 190, and provide releasable frictional engagement between at least the side wall projections 137 in the speaker grill 190 (i.e., between the side wall projections 137 and portions of the outer surface 195 of the frame portion 194 of an inserted speaker grill 190). It should be understood that the material or materials used to form the speaker cover 100 and/or various components of the speaker cover 100 is a design choice based on the desired appearance and functionality of the speaker cover 100.

In certain exemplary embodiments, the speaker cover 100 comprises a flange disposed about a perimeter thereof, wherein the flange comprises a plurality of fasteners operably connected to the flange on the lower surface of the speaker cover 100. The plurality of fasteners is utilized to removably secure the speaker cover 100 to an outer face of a speaker grill 190, thereby providing protection from environmental damage. In certain exemplary embodiments, the speaker cover 100 is configured to operably connect a gasket to the flange to achieve a watertight fit, however in other embodiments other seals of similar functionality are utilized. In an illustrative embodiment, the plurality of fasteners disposed along the flange comprises a total of four fasteners, spaced at even intervals about the perimeter. However, in other embodiments, the plurality of fasteners fluctuates as necessary for speaker grills 190 of varying sizes and models. In certain embodiments, the fasteners are clips, however in other embodiments the fasteners comprise magnets, snaps, or other suitable fasteners.

In certain embodiments, the speaker cover 100 is configured to attach to a front surface of the speaker grill 190, but in other embodiments the speaker cover 100 is adapted to slide over the front of the speaker grill 190, v/herein the speaker cover 100 is still removably secured to the speaker grill 190 through one or more fasteners.

Figure 10:
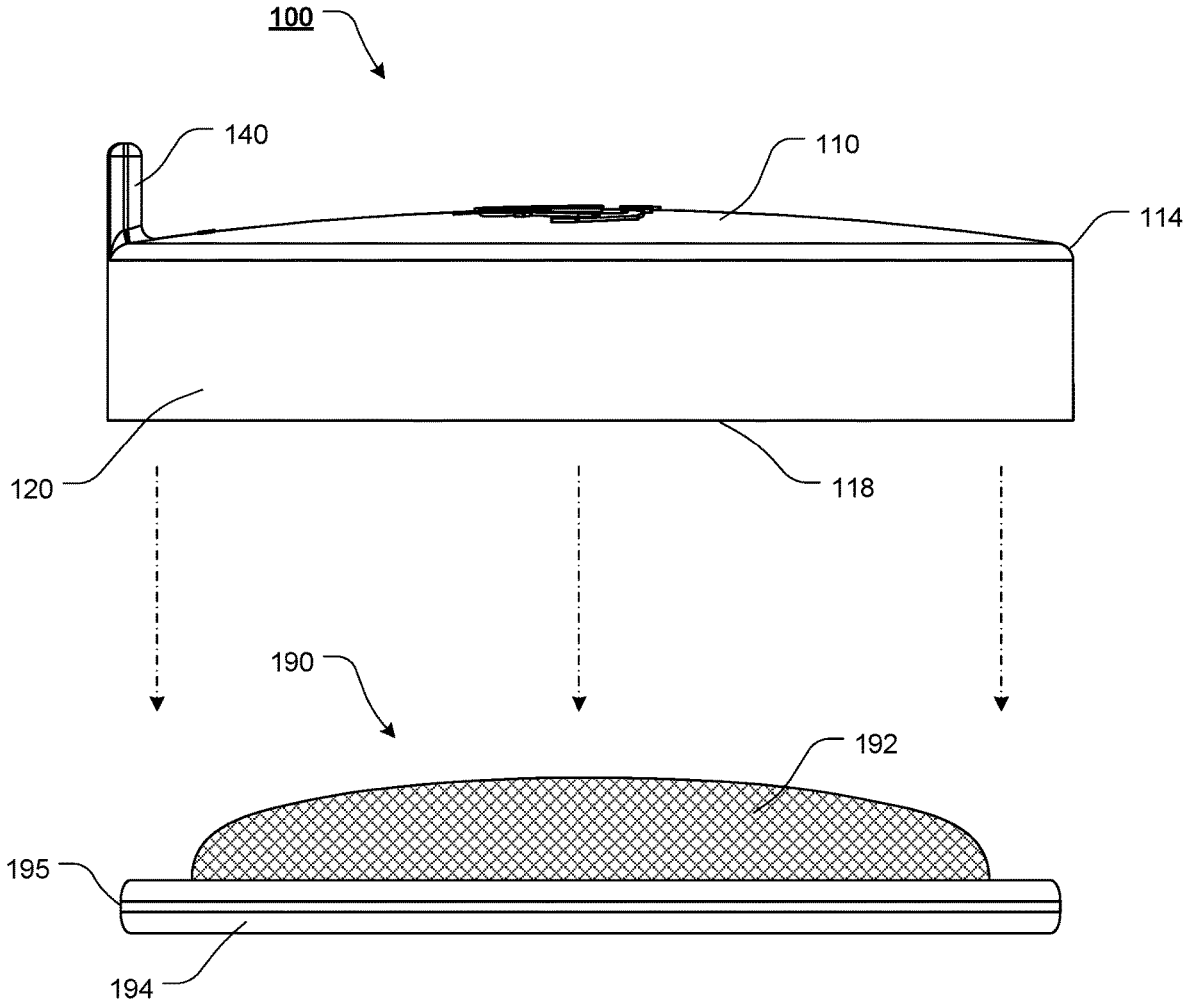
FIG. 10 illustrates a side view of an exemplary embodiment of a speaker cover, wherein the exemplary speaker cover is aligned with an exemplary speaker grill, according to the present disclosure.

During use of the speaker cover 100, as illustrated most clearly in FIGS. 10-12, the speaker cover 100 is initially aligned with the speaker grill 190 such that the interior cavity 130 is aligned with the speaker grill 190.

Once properly aligned, the speaker cover 100 is further urged toward the speaker grill 190, such that the side wall projections 137 contact the outer surface 195 of the frame portion 194 of the speaker grill 190. As the side wall projections 137 contact the outer surface 195, at least portions of the speaker cover 100 are stretched or expanded such that at least certain of the side wall projections 137 frictionally engage the outer surface 195.

When the speaker cover 100 is appropriately positioned relative to the speaker grill 190, as illustrated, for example, in FIGS. 11-12, at least a portion of certain of the side wall projections 137 frictionally engage portions of the outer surface 195 to maintain the speaker cover 100 in a desired position.

When appropriately positioned relative to the speaker grill 190, the air gaps 138, formed by the interior side wall 123, between each of the side wall projections 137, allow air to flow between portions of the inserted speaker grill 190 and the interior side wall 123.

Additionally, if included, one or more of the top wall projections 135 contact at least a portion of the outer surface of the grill portion 192 of the speaker grill 190. The air gaps 136 allow air to flow between portions of the inserted speaker grill 190 and the interior top wall 115.

It should be appreciated that the speaker (typically beneath the speaker grill 190) can be used while the speaker cover 100 is in place.

In order to remove the protective cover 100, a removal force is applied to the pull tab 140, urging the pull tab 140 (and of the speaker cover 100) upward, away from the speaker grill 190.

FIG. 13 illustrates an exemplary embodiment of a speaker cover 200, according to the present disclosure. As illustrated, the speaker cover 200 includes at least some of an interior top wall 215, a proximate center 217, at least one exterior side wall 220, an exterior terminal edge 218, an interior side wall 223, an interior terminal edge 227, at least partial interior cavity 230, and one or more side wall projection(s) 237.

It should be understood that each of these elements corresponds to and operates similarly to the interior top wall 115, the proximate center 117, the at least one exterior side wall 120, the exterior terminal edge 118, the interior side wall 123, the interior terminal edge 127, the at least partial interior cavity 130, and the one or more side wall projection(s) 137, as described with reference to the speaker cover 100 of FIGS. 1-12.

However, the one or more top wall projections 235, as illustrated in FIG. 13, comprise a plurality of spaced apart top wall projections 235. The top wall projections 235 may optionally be positioned at patterned or random positions relative to the interior top wall 215.

FIG. 14 illustrates an exemplary embodiment of a speaker cover 300, according to the present disclosure. As illustrated, the speaker cover 300 includes at least some of an interior top wall 315, a proximate center 317, at least one exterior side wall 320, an exterior terminal edge 318, an interior side wall 323, an interior terminal edge 327, at least partial interior cavity 330, and one or more side wall projection(s) 337.

It should be understood that each of these elements corresponds to and operates similarly to the interior top wall 115, the proximate center 117, the at least one exterior side wall 120, the exterior terminal edge 118, the interior side wall 123, the interior terminal edge 127, the at least partial interior cavity 130, and the one or more side wall projection(s) 137, as described with reference to the speaker cover 100 of FIGS. 1-12.

However, the one or more top wall projections 335, as illustrated in FIG. 14, comprise a plurality of concentric substantially circular top wall projections 335.

FIG. 15 illustrates an exemplary embodiment of a speaker cover 400, according to the present disclosure. As illustrated, the speaker cover 400 includes at least some of an interior top wall 415, a proximate center 417, at least one exterior side wall 420, an exterior terminal edge 418, an interior side wall 423, an interior terminal edge 427, at least partial interior cavity 430, and one or more side wall projection(s) 437.

It should be understood that each of these elements corresponds to and operates similarly to the interior top wall 115, the proximate center 117, the at least one exterior side wall 120, the exterior terminal edge 118, the interior side wall 123, the interior terminal edge 127, the at least partial interior cavity 130, and the one or more side wall projection(s) 137, as described with reference to the speaker cover 100 of FIGS. 1-12.

However, the one or more top wall projections 435, as illustrated in FIG. 15, comprise a plurality of sinusoidal or wave shaped top wall projections 435.

Figure 16:
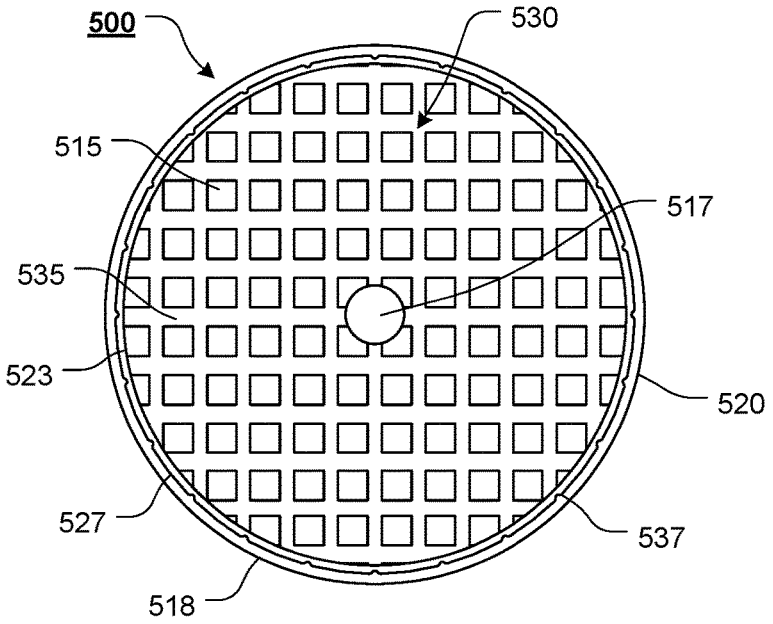
FIG. 16 illustrates a bottom view of an exemplary embodiment of a speaker cover, according to the present disclosure.

FIG. 16 illustrates an exemplary embodiment of a speaker cover 500, according to the present disclosure. As illustrated, the speaker cover 500 includes at least some of an interior top wall 515, a proximate center 517, at least one exterior side wall 520, an exterior terminal edge 518, an interior side wall 523, an interior terminal edge 527, at least partial interior cavity 530, and one or more side wall projection(s) 537.

It should be understood that each of these elements corresponds to and operates similarly to the interior top wall 115, the proximate center 117, the at least one exterior side wall 120, the exterior terminal edge 118, the interior side wall 123, the interior terminal edge 127, the at least partial interior cavity 130, and the one or more side wall projection(s) 137, as described with reference to the speaker cover 100 of FIGS. 1-12.

However, the one or more top wall projections 535, as illustrated in FIG. 16, comprise a grid-shaped top wall projection 535. In certain exemplary embodiments, the interior top wall 515 forms a series of spaced apart squares or other geometric shapes or patterns defining the grid-shaped top wall projection 535.

While the speaker cover 100, 200, 300, 400, and/or 500 are described as being formed of a semirigid or flexible material, it should be appreciated that in various exemplary, nonlimiting embodiments, the speaker cover 100, 200, 300, 400, and/or 500 may optionally be formed of a rigid or substantially rigid material, such as, for example, a hard plastic.

In various exemplary embodiments, the speaker cover 100, 200, 300, 400, and/or 500 is substantially rigid and is formed of a polymeric material such as a polymeric composite. Alternate materials of construction may include one or more of the following: hardened rubber or silicone, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, woven fiber, natural materials, such as, for example, leather, and/or various combinations of the foregoing.

Thus, it should be understood that the material or materials used to form the speaker cover 100, 200, 300, 400, and/or 500 is a design choice based on the desired appearance and functionality of the speaker cover.

As illustrated in FIGS. 18-22, the speaker cover 100, as illustrated and described in connection with FIGS. 1-12, comprises a two-piece speaker cover including the speaker cover 100, and a cover element 600. It should be understood that each of the elements of the speaker cover 100, as illustrated in FIGS. 18-22, correspond to and operate as described with reference to the speaker cover 100, 200, 300, 400, and/or 500 of FIGS. 1-17.

However, as illustrated in FIGS. 18-22, the cover element 600 includes at least some of an exterior top portion 610 and an interior top wall 615. The interior top wall 615 extends to an interior edge portion 619. The cover element 600 may be formed of a rigid material, a semi-rigid material, or a substantially flexible material.

In various exemplary embodiments, the cover element 600 is substantially rigid and is formed of a polymeric material such as a polymeric composite. Alternate materials of construction may include one or more of the following: hardened rubber or silicone, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, woven fiber, natural materials, such as, for example, leather, and/or various combinations of the foregoing.

Thus, it should be understood that the material or materials used to form the cover element 600 is a design choice based on the desired appearance and functionality of the speaker cover.

Figure 18:
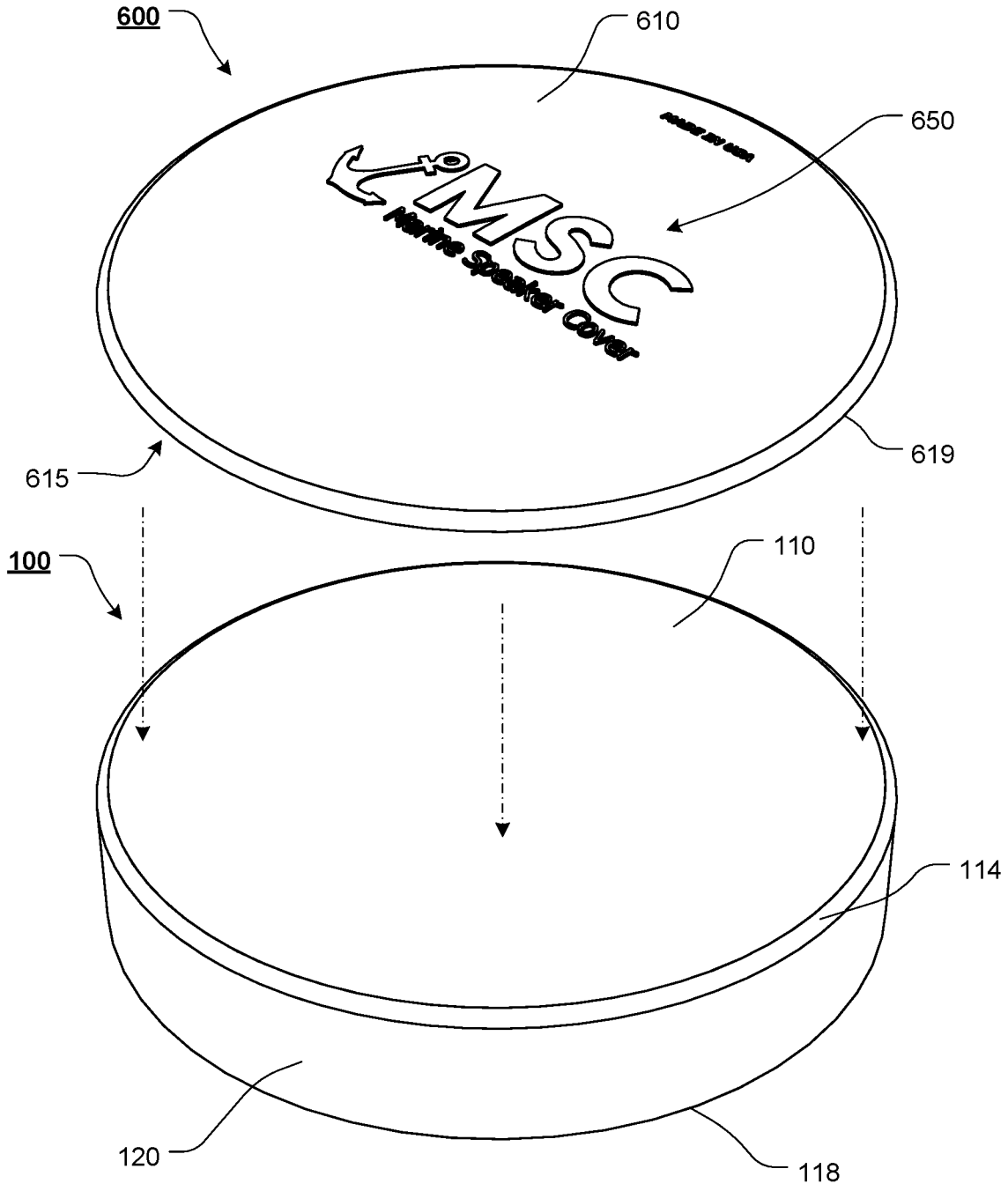
FIG. 18 illustrates a perspective view of aligned components of an exemplary embodiment of a speaker cover, according to the present disclosure.
Figure 19:
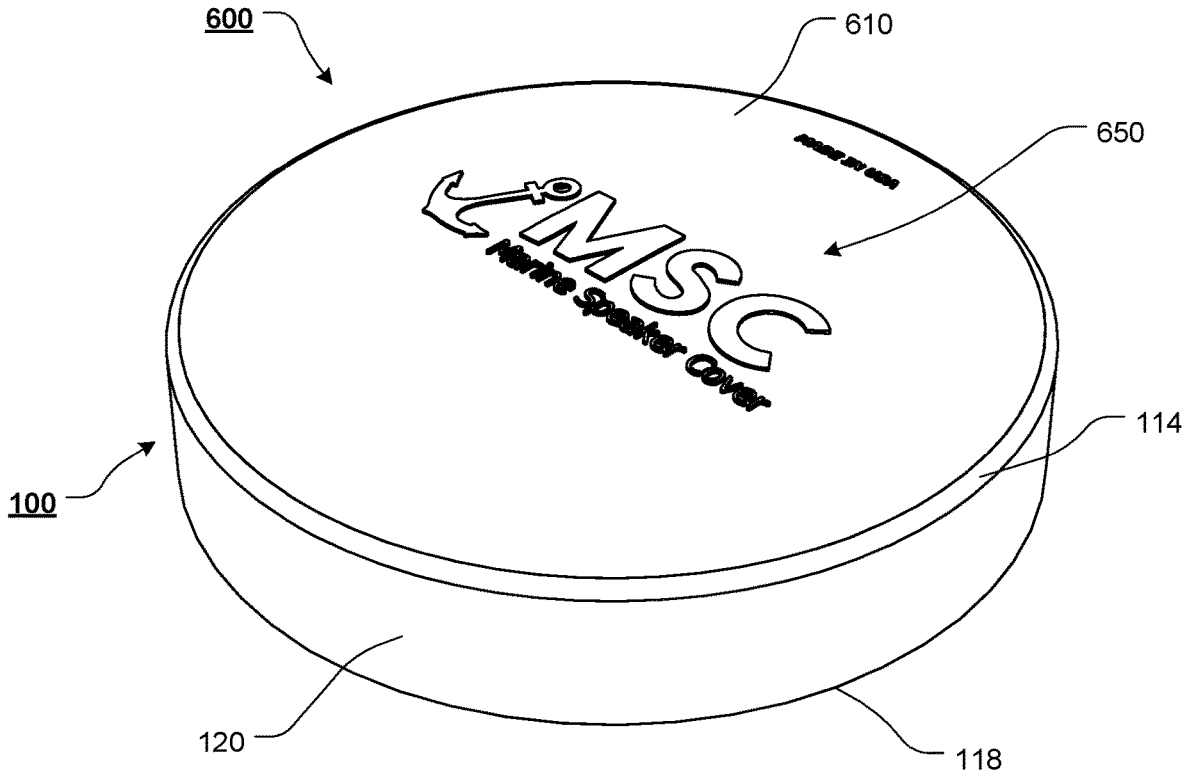
FIG. 19 illustrates a perspective view of assembled components of an exemplary embodiment of a speaker cover, according to the present disclosure.

During assembly, the cover element 600 is aligned with the exterior top portion 110 of the speaker cover 100. Once appropriately aligned and positioned relative to the exterior top portion 110, as illustrated in FIG. 18, the interior top wall 615 of the cover element 600 is attached or coupled, via epoxy, polymer, resin, epoxy, polymer, or other adhesive bonding, etc., to the exterior top portion 110 of the speaker cover 100, as illustrated in FIG. 19.

In various exemplary, nonlimiting embodiments, indicia 650 may optionally be formed as part of, applied to, embedded in, or attached or coupled to a portion of the exterior top portion 610. If included, the indicia 650 may represent a trademark or other word, phrase, or element, thereby providing additional originality to the cover element 600.

Figure 20:
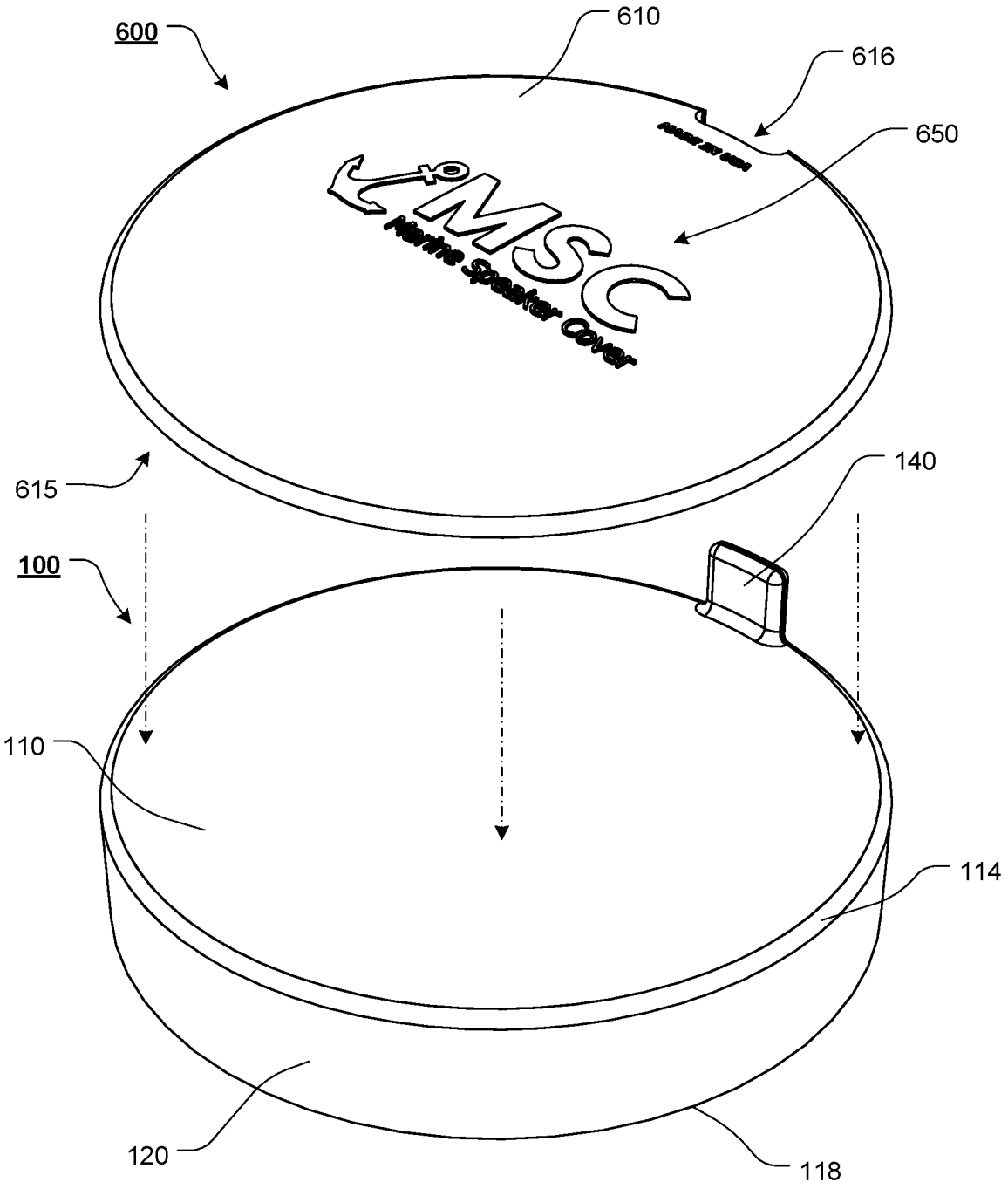
FIG. 20 illustrates a perspective view of aligned components of an exemplary embodiment of a speaker cover, according to the present disclosure.
Figure 21:
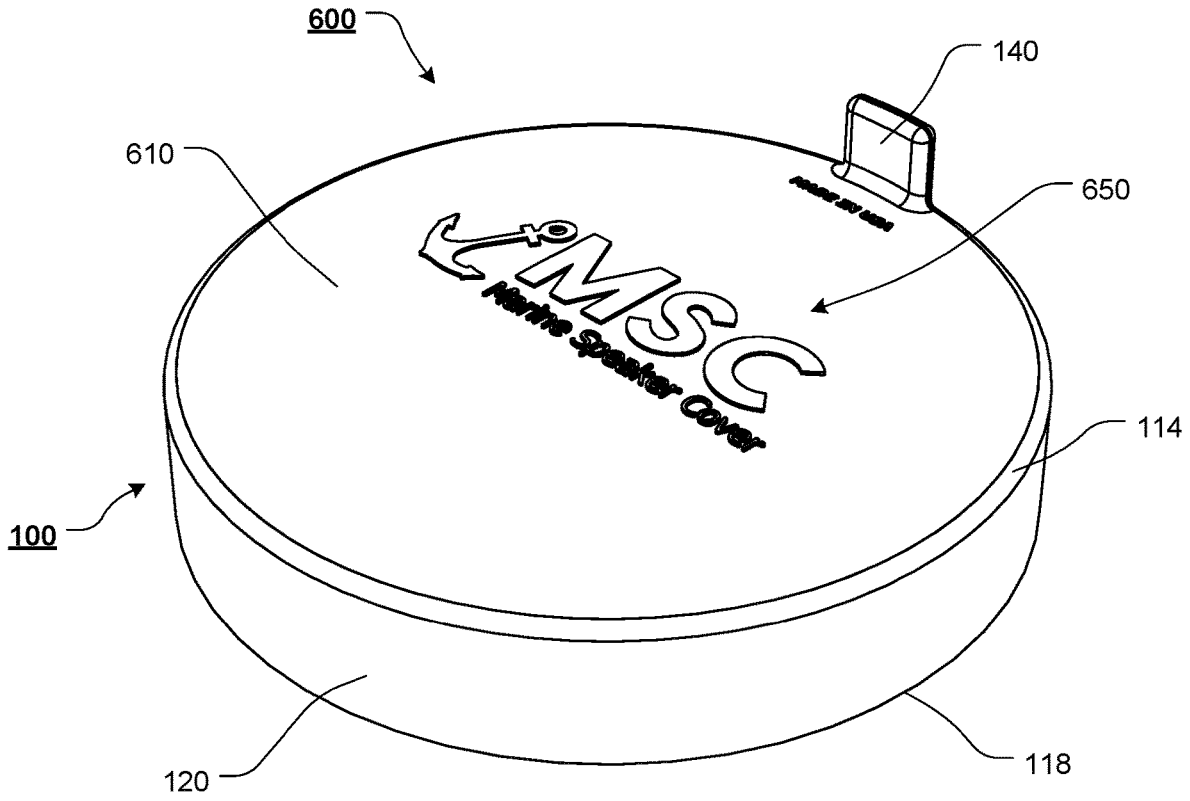
FIG. 21 illustrates a perspective view of assembled components of an exemplary embodiment of a speaker cover, according to the present disclosure.

As illustrated in FIG. 20, a recess or notch 616 is formed in a portion of the interior edge portion 619. The notch 616 is formed so as to be aligned with the at least one pull tab 140, as illustrated in FIG. 20, and allow a portion of the at least one pull tab 140 to extend through a portion of the cover element 600, when the cover element 600 is attached or coupled atop the speaker cover 100, as illustrated in FIG. 21.

Figure 22:
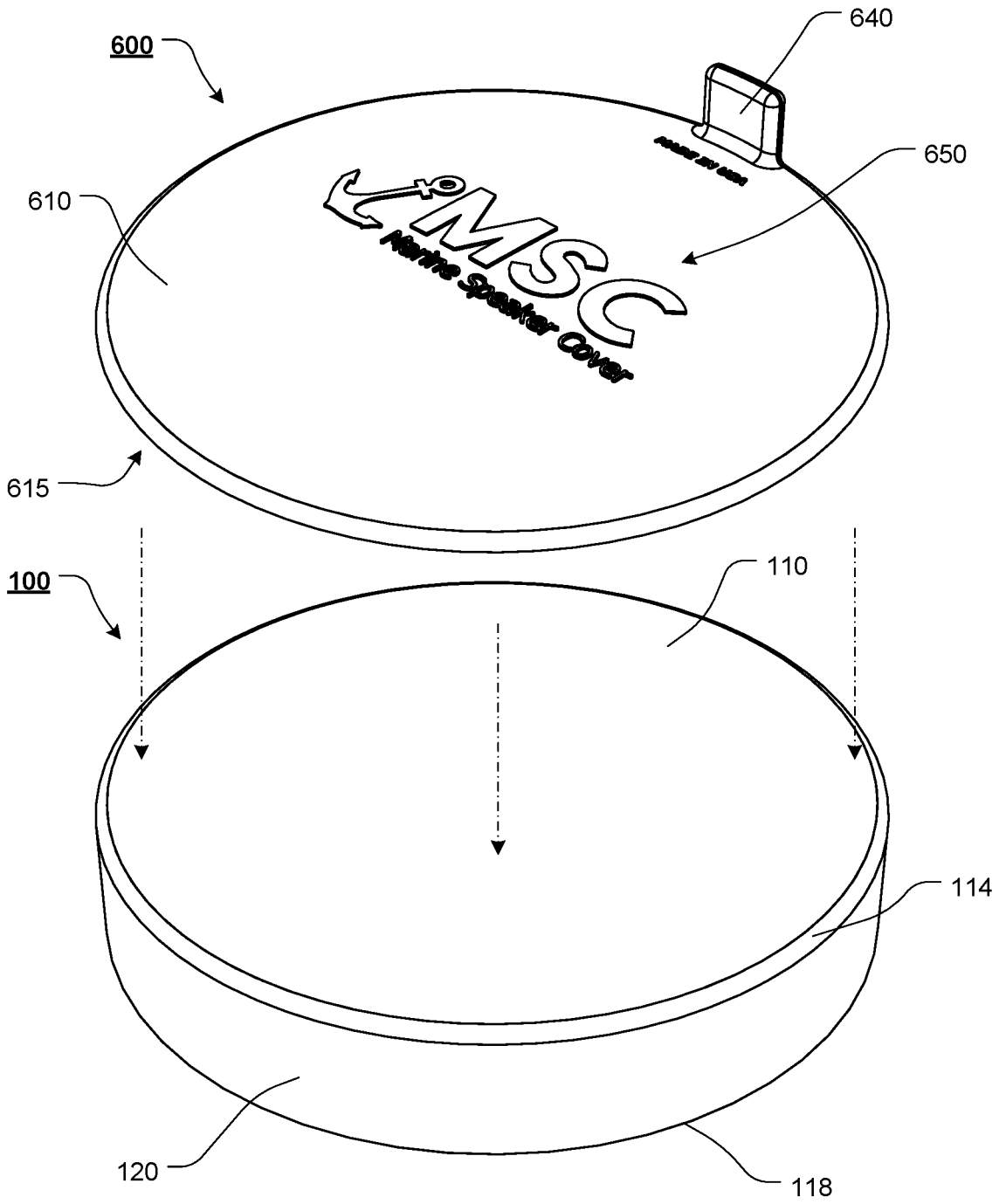
FIG. 22 illustrates a perspective view of aligned components of an exemplary embodiment of a speaker cover, according to the present disclosure.

As illustrated in FIG. 22, at least one pull tab 640 extends from a portion of the cover element 600. In various exemplary embodiments, the pull tab 640 is positioned so as to extend from the exterior top portion 610 and provide sufficient area to be grasped by a user's fingers, as with the at least one pull tab 140.

Figure 23:
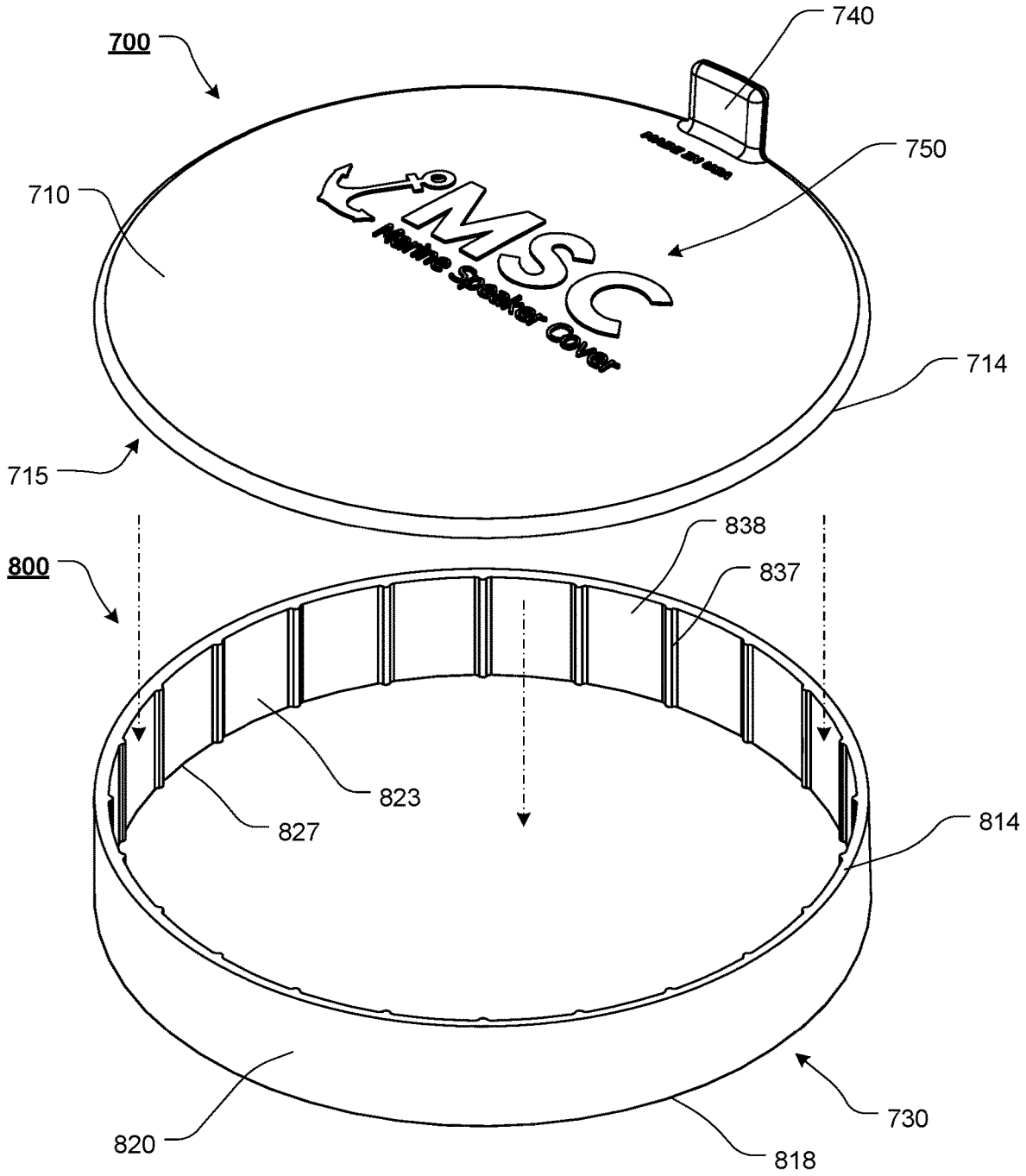
FIG. 23 illustrates a perspective view of aligned components of an exemplary embodiment of a speaker cover, according to the present disclosure.

As illustrated in FIG. 23, the speaker cover comprises a cover element 700 and a substantially flexible skirt element 800. The cover element 700 includes at least some of an exterior top portion 710 and an interior top wall 715. The interior top wall 715 extends to an interior edge portion 719. The interior top wall 715 generally extends from a proximate center 717 to the interior edge portion 719. One or more top wall projections 735 extend from the interior top wall 715.

The cover element 700 may be formed of a rigid material, a semi-rigid material, or a substantially flexible material. In various exemplary embodiments, the cover element 700 is substantially rigid and is formed of a polymeric material such as a polymeric composite. Alternate materials of construction may include one or more of the following: hardened rubber or silicone, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, woven fiber, natural materials, such as, for example, leather, and/or various combinations of the foregoing.

Thus, it should be understood that the material or materials used to form the cover element 700 is a design choice based on the desired appearance and functionality of the speaker cover.

Figure 24:
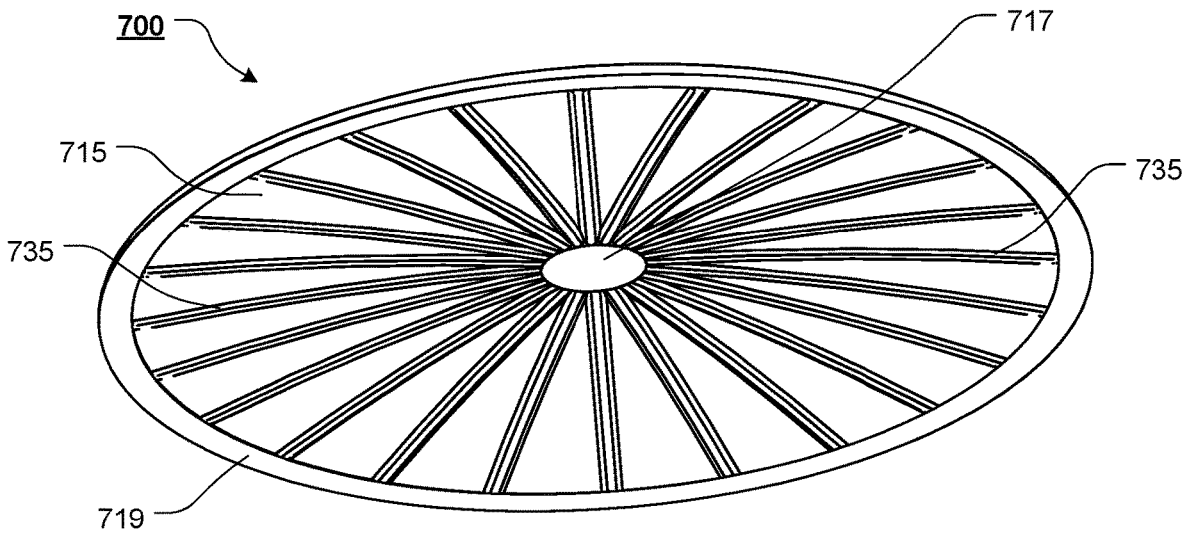
FIG. 24 illustrates a lower, perspective view of an exemplary embodiment of a cover element, according to the present disclosure.

The interior top wall 715 of the cover element 700 may optionally include any or all of the features and/or elements of the interior top wall 115 of the speaker cover 100, 200, 300, 400, and/or 500, such as, for example, the one or more top wall projections 135 and/or air gaps 136, as illustrated in FIG. 24.

The skirt element 800 corresponds to the exterior side wall 120 and the interior side wall 123. The skirt element 800 includes an exterior side wall 820 and an interior side wall 823. The skirt element 800 extends from an edge portion 814 to an exterior terminal edge 818. The interior side wall 823 is generally formed substantially opposite at least a portion of the exterior side wall 820 and extends from the interior edge portion 819 to the interior terminal edge 827. By including the one or more side wall projections 837, air gaps 838 are formed by the interior side wall 823, between each of the side wall projections 837.

During assembly, the cover element 700 is aligned with the skirt element 800, as illustrated in FIG. 23. Once appropriately aligned and positioned relative to the cover element 700, the edge portion 814 of the skirt element 800 is attached or coupled, via epoxy, polymer, resin, epoxy, polymer, or other adhesive bonding, etc., to the interior edge portion 719 of the cover element 700. Thus, once assembled, the comparatively more flexible skirt element 800 extends downward from the comparatively more rigid cover element 700. The area within the interior top wall 715 and the interior side wall 823 defines an at least partial interior cavity 730 for receiving at least a portion of a speaker grill 190.

In various exemplary, nonlimiting embodiments, indicia 750 may optionally be formed as part of, applied to, embedded in, or attached or coupled to a portion of the exterior top portion 710. If included, the indicia 750 may represent a trademark or other word, phrase, or element, thereby providing additional originality to the cover element 700.

Figure 25:
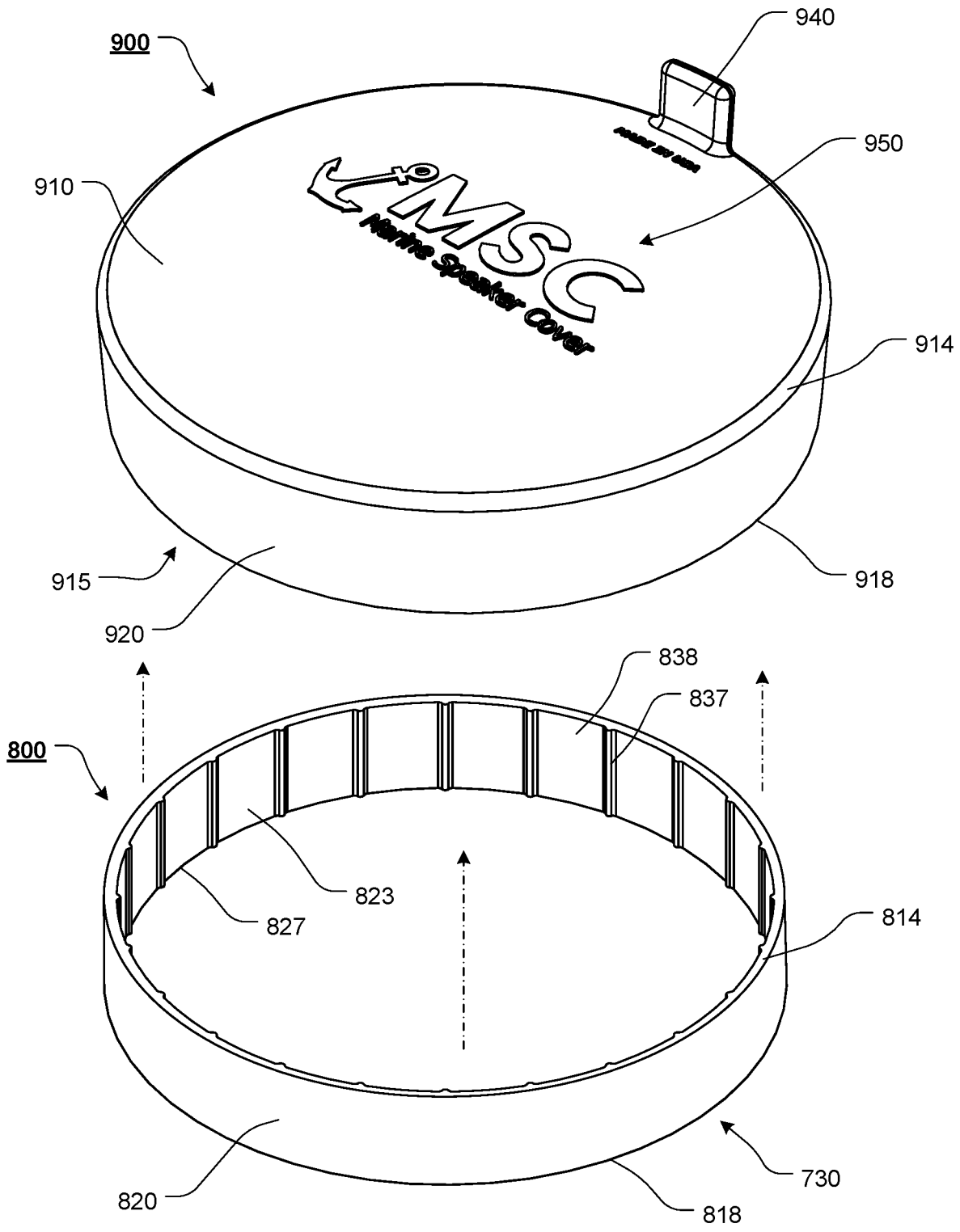
FIG. 25 illustrates a perspective view of aligned components of an exemplary embodiment of a speaker cover, according to the present disclosure.
Figure 26:
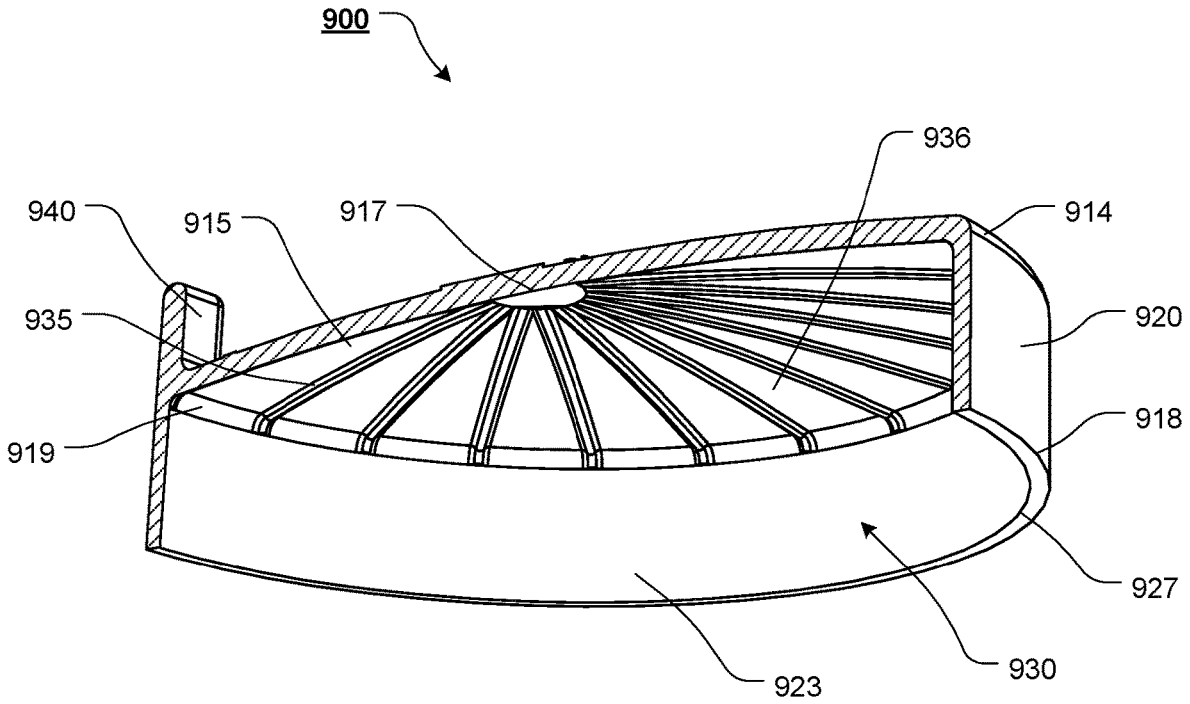
FIG. 26 illustrates a lower, perspective, cross-sectional view of an exemplary embodiment of a cover element, according to the present disclosure.

As illustrated in FIGS. 25 and 26, the speaker cover comprises a cover element 900 and a substantially flexible skirt element 800.

As illustrated, the cover element 900 includes at least some of an edge portion 914, an interior top wall 915, a proximate center 917, at least one exterior side wall 920, an exterior terminal edge 918, an interior edge portion 919, an interior side wall 923, an interior terminal edge 927, at least partial interior cavity 930, one or more top wall projections 935, air gaps 936, and/or the pull tab 940.

It should be understood that each of these elements corresponds to and operates similarly to the edge portion 114, the interior top wall 115, the proximate center 117, the at least one exterior side wall 120, the exterior terminal edge 118, the interior edge portion 119, the interior side wall 123, the interior terminal edge 127, the at least partial interior cavity 130, the one or more top wall projections 135, the air gaps 136, and/or the pull tab 140, as described with reference to the speaker cover 100.

However, the one or more side wall projection(s) 137, as described with reference to the speaker cover 100, are removed. The substantially flexible skirt element 800, including the side wall projections 837, is positioned within the interior sidewall 923 of the cover element 900.

By utilizing the flexible skirt element 800 within the cover element 900, the extent to which the side wall projections 837 extend from the interior side wall 823, can be altered. In this manner, various sized or shaped flexible skirt elements 800 may be employed such that the size and/or shape of the speaker with which the cover element may be utilized can be changed.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "an", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A speaker cover, comprising:

an exterior top portion extending from a proximate center to an edge portion;

at least one exterior side wall extending from said edge portion to an exterior terminal edge;

an interior top wall formed substantially opposite at least a portion of said exterior top portion, wherein said interior top wall extends from a proximate center to an interior edge portion;

an interior side wall formed substantially opposite at least a portion of said exterior side wall, wherein said interior side wall extends from said interior edge portion to an interior terminal edge, wherein an at least partial interior cavity is defined by said interior top wall and said interior side wall, wherein one or more top wall projections are formed integral to said interior top wall, wherein said one or more top wall projections extend from at least a portion of said interior top wall into said interior cavity to rest atop a portion of a speaker, wherein one or more side wall projections are formed integral to said interior side wall, and wherein said one or more side wall projections extend from at least a portion of said interior side wall, at spaced apart locations, into said interior cavity; and a cover element having at least one pull tab extending from a portion of said cover element, wherein said cover element is attached or coupled to at least a portion of said exterior top portion.

2. The speaker cover of claim 1, wherein said speaker cover is contoured or shaped to accommodate a specific type or model of speaker grill within said cavity.

3. The speaker cover of claim 1, wherein said exterior top portion is substantially dome shaped.

4. The speaker cover of claim 1, wherein said exterior top portion comprises a substantially planar surface.

5. The speaker cover of claim 1, wherein said edge portion is configured to a substantially circularly shaped or is configured to a geometric shape.

6. The speaker cover of claim 1, wherein indicia is formed as part of, applied to, embedded in, or attached or coupled to a portion of said exterior top portion.

7. The speaker cover of claim 1, wherein said cover element is substantially rigid.

8. The speaker cover of claim 1, wherein said pull tab extends from an exterior top portion of said cover element.

9. The speaker cover of claim 1, wherein said pull tab includes a textured surface portion.

10. The speaker cover of claim 1, wherein said side wall projections extend from said interior edge portion to said interior terminal edge.

11. The speaker cover of claim 1, wherein an air gap is formed by said interior side wall, between each of said side wall projections.

12. The speaker cover of claim 1, wherein an air gap is formed by said interior top wall, between each of said top wall projections.

13. The speaker cover of claim 1, wherein said top wall projections comprise a plurality of elongate or linear projections that extend radially from an area surrounding said proximate center to said interior edge portion.

14. The speaker cover of claim 1, wherein said top wall projections comprise a plurality of sinusoidal or wave shaped projections.

15. The speaker cover of claim 1, wherein said top wall projections comprise a plurality of spaced apart projections.

16. The speaker cover of claim 1, wherein said top wall projections comprise a plurality of concentric, substantially circular projections.

17. The speaker cover of claim 1, wherein said speaker cover is formed of an at least partially resilient material.

18. A speaker cover, comprising:

a cover element having an exterior top portion extending to an edge portion;

at least one exterior side wall extending from said edge portion;

an interior top wall formed substantially opposite at least a portion of said exterior top portion, wherein said interior top wall extends from a proximate center to an interior edge portion;

a cover element interior side wall formed substantially opposite at least a portion of said exterior side wall, wherein said cover element interior side wall extends from said interior edge portion, wherein an at least partial interior cavity is defined by said interior top wall and said cover element interior side wall, and wherein one or more integrally formed top wall projections extend from said interior top wall into said interior cavity to rest atop a portion of a speaker; and a substantially flexible skirt element having a skirt element interior side wall, wherein one or more integrally formed side wall projections extend from at least a portion of said skirt element interior side wall, at spaced apart locations, and wherein said skirt element is positioned within said cover element interior side wall.

19. A speaker cover, comprising:

an exterior top portion;

at least one exterior side wall extending from said exterior top portion;

an interior top wall formed substantially opposite at least a portion of said exterior top portion;

an interior side wall formed substantially opposite at least a portion of said exterior side wall, wherein an at least partial interior cavity is defined by said interior top wall and said interior side wall;

one or more integrally formed top wall projections extending from at least a portion of said interior top wall configured to rest atop a portion of a speaker;

one or more integrally formed side wall projections extending from at least a portion of said interior side wall; and a cover element attached or coupled to at least a portion of said exterior top portion.

20. The speaker cover of claim 19, wherein one or more top wall projections extend from at least a portion of said interior top wall into said at least partial interior cavity.

* * * * *